United States Patent [19]

Collbrunn et al.

[11] 4,227,471

[45] Oct. 14, 1980

[54] SEWING-MACHINE GUIDE FOR EDGE-PARALLEL SEAMING OF A WORKPIECE

[75] Inventors: Harald Collbrunn, Spenge; Franz Hannemann, Detmold; Heinz Fransing, Melle, all of Fed. Rep. of Germany

[73] Assignee: Dürkoppwerke GmbH Bielefeld, Bielefeld, Fed. Rep. of Germany

[21] Appl. No.: 914,143

[22] Filed: Jun. 9, 1978

[30] Foreign Application Priority Data

Jun. 28, 1977 [DE] Fed. Rep. of Germany ..... 2728967

[51] Int. Cl.[2] ..... D05B 35/10

[52] U.S. Cl. ..... 112/121.26; 112/121.15; 112/305; 112/306

[58] Field of Search ..... 112/121.26, 153, 136, 112/140, 121.15, 148, 220, 152, 121.11, 12.12, 311, 305, 306, 121.27

[56] References Cited

U.S. PATENT DOCUMENTS

| | | | |
|---|---|---|---|
| 3,903,818 | 9/1975 | Marforio | 112/121.15 |
| 4,013,025 | 3/1977 | Marforio | 112/121.26 |
| 4,019,448 | 4/1977 | Marforio | 112/153 |
| 4,062,309 | 12/1977 | Pollmeier et al. | 112/121.26 X |
| 4,086,860 | 5/1978 | Kosnow et al. | 112/306 |
| 4,102,280 | 7/1978 | Hannemann | 112/121.26 |
| 4,102,281 | 7/1978 | Collbrunn | 112/121.26 |
| 4,116,142 | 9/1978 | Sanvito | 112/121.26 |
| 4,135,464 | 1/1979 | Sanvito | 112/136 X |

FOREIGN PATENT DOCUMENTS

| | | | |
|---|---|---|---|
| 2424643 | 12/1974 | Fed. Rep. of Germany | 112/121.15 |

*Primary Examiner*—Werner H. Schroeder
*Assistant Examiner*—Andrew M. Falik
*Attorney, Agent, or Firm*—Karl F. Ross

[57] ABSTRACT

A system for the edge-parallel sewing of a workpiece, consisting of a plurality of layers, together to form a seam, e.g. in the production of trouser legs, pockets, shirts and the like, comprises a workpiece guide in the region of the needle path and formed with separators interposed between the layers, and a drag-clamping device which engages a portion of the stack of fabric layers remote from the incipient stitching operation to apply a stretching or drag force thereto. According to the invention, a retracting device is provided which, upon approach of the drag clamp to the stitching location, withdraws the guide device out of the path of the clamp.

10 Claims, 4 Drawing Figures

SEWING-MACHINE GUIDE FOR EDGE-PARALLEL SEAMING OF A WORKPIECE

CROSS REFERENCE TO RELATED APPLICATION

The present application is related to application Ser. No. 746,880 filed 2 December 1976 (now U.S. Pat. Nos. 4,102,281), and Ser. No. 769,202 filed 16 Feb. 1977 (now U.S. Pat. No. 4,102,280). These applications are commonly assigned and copending with the present case.

FIELD OF THE INVENTION

The present invention relates to an automatic sewing-machine system which enables an edge-parallel seam to be provided in a workpiece stack consisting of a plurality of layers. More particularly, the invention relates to sewing apparatus for the stitching of edge-parallel edge seams in multilayer workpieces.

BACKGROUND OF THE INVENTION

It is known, e.g. from the following patents and other publications of record in the above-identified applications:

U.S. Pat. No. 3,921,550
U.S. Pat. No. 3,794,230
U.S. Pat. No. 4,013,026
U.S. Pat. No. 3,782,310
U.S. Pat. No. 3,973,507
U.S. Pat. No. 4,013,025
U.S. Pat. No. 3,162,154
U.S. Pat. No. 3,903,818
U.S. Pat. No. 3,713,408
U.S. Pat. No. 4,030,430
German utility model (Gebrauchmuster) No. 73 30 505
German utility model (Gebrauchmuster) No. 74 38 034 and
German utility model (Gebrauchmuster) No. 73 19 362 to provide devices for the edge-parallel stitching of two or more fabric workpieces forming a stack, together along an edge seam with a sewing machine in which the fabric stack is advanced past the stitching location by fabric-feed dogs or presser feet constituting the usual fabric-feed means.

The sewing machine can be a conventional automatic sewing machine having an arm overhanging the stitching plate from which the fabric-feed dogs emerge or an arm from which a presser foot depends, to displace the workpieces in a predetermined sewing direction.

In the arm, the needle is reciprocated generally transversely to the stitching plate or table, usually in a more or less vertical or slightly inclined needle path. Such machines have been used for a variety of automatic sewing operations, for example, the stitching of seams in trouser legs, the sewing of pocket pieces into trousers, the stitching of the seams of shirts, blouses and jackets and, indeed, for a variety of applications in the garment-making field.

In general, an apparatus of the type described can include a fabric-feed sewing machine, in which the fabric-advancing or feed device is the feed dogs which are disposed in or below the work table or stitching plate, a workpiece-guide device located upstream of the stitching location in the direction of advance of the workpiece therepast and hence upstream of the feed dogs, and a drag clamp which is generally affixed to the stack of workpieces to be sewed together at a location remote from the starting of the seam so as to exert a force opposite that applied by the feed dogs, thereby stretching the workpieces and enabling them to pass in the proper orientation past the stitching location.

The workpiece-guide device can comprise a plurality of spaced-apart plates which lie parallel to the plane of the stitch plate and are interposed between the layers of fabric to be sewn together. In addition, the guide includes a guide surface or wall disposed laterally of the needle path and along which the edge of the fabric stack is intended to be guided.

The drag-clamping device engages the ends of the fabric stack remote from the portion thereof through which the needle passes during the inception of the stitching seam and can move with the fabric along a predetermined path while exerting a force in the opposite direction upon the workpieces. This, as already indicated, maintains the workpieces taut during the stitching operation.

Such devices are known, e.g. from the aforementioned copending applications and some of the other references mentioned above, and can be used with effectiveness for sewing, in edge-parallel relationship, a plurality of fabric layers which are to be joined together in an edge seam and which are comparatively long. Trouser legs, for example, are in this category.

With such devices, the ends of the fabric pieces remote from the stitching location are fixed in relation to one another by the drag clamping device so that, as the stack of fabric layers is drawn past the stitching location, the stitched seam can proceed without monitoring or control and without relative shifting of the fabric layers.

In conventional sewing installations of this type, the drag-clamp device is entrained with the fabric until just before the end of the fabric reaches the workpiece-guide device which, as previously indicated, is located at the upstream side of the needle path. At this point, the clamp of the drag unit opens and releases the end of the workpiece stack.

From this instant on, the sections of the fabric layers which are drawn past the needle location are no longer fixed relative to one another with the result that the stitching process over these sections is not always edge-parallel as is desired or required.

OBJECTS OF THE INVENTION

It is the principal object of the present invention to provide an improved workpiece-guide system for sewing machines which advances the principles of the afore-described copending applications but avoids problems encountered with earlier workpiece-guide devices using drag clamps.

Still another object of the invention is to provide an improved sewing-machine system which allows relatively long fabric workpiece stacks to be advanced through the sewing machine with a minimum of control or monitoring by operating personnel.

Still another object of the invention is to provide a sewing installation of the type described, namely, one having a workpiece-guide device upstream of the stitching location and a drag clamp, whereby sections of the workpiece need not be permitted to pass freely through the stitching location and thereby be subject to faulty seaming.

Yet another object of the invention is to provide a device of the character described which, in a particularly reliable and economic fashion, obviates the afore-described disadvantages.

SUMMARY OF THE INVENTION

These objects and others which will become apparent hereinafter are attained, in accordance with the present invention, in an apparatus of the afore-described basic type, i.e. one having a sewing machine provided with fabric-feed means for advancing a workpiece consisting of a stack of fabric layers past a stitching location, needle means defining a needle path at this location in such a way that a seam is formed in the workpiece, fabric-guide means immediately upstream of the stitching location with respect to the direction of feed of the workpiece, the guide means including a plurality of plates for separating the layers and a guide wall engaged by the guided edge thereof, and a drag clamp engageable with the workpiece stack remote from the stitching location for holding the layers in fixed relationship to one another, the drag clamp exerting a force upon the workpieces in a direction opposite the direction of advance thereof past the stitching location. In an apparatus of this type, the invention overcomes the disadvantages of the earlier systems by providing means for shifting the workpiece-guide device out of the path of the drag-clamp device when the latter approaches the stitching location or the workpiece-guide device, thereby allowing the drag clamp to come closer to the stitching location than has been possible heretofore. According to the invention, along the guide track or path of the drag clamp, a control means, e.g. a switch, is activated by the drag clamp to trigger the operation of the means for retracting the workpiece-guide device. This retracting means can be fluid-operating (e.g. pneumatic) or electrically operated as desired.

With such an arrangement, the ends of the workpiece layers which have been clamped together by the drag clamp are retained in their fixed relation to one another until the drag clamp practically reaches the stitching location. As a consequence, undesired lateral relative shifting of the fabric layers is no longer possible over any extended lengths thereof.

According to a further feature of the invention, the fabric layers are secured in the drag clamp device substantially at the center of the seam (seam center) and, for workpieces with convex or concave edge formations, the guide rail for the drag-clamp device is inclined to the guide wall of the workpiece-guide device. The guide wall of the workpiece-guide device may be formed by a plurality of spaced-apart members.

This arrangement of the device can be used in combination with a guide rail for the drag clamp which is mounted on the table or stitch plate so as to be swingable about a vertical axis disposed substantially at the seam center at the level of the forward edges of the presser foot of the sewing machine.

This has been found to enable the proper positioning of the guide rail for feeding the workpiece ends optimally so that a constant spacing of the stitched seam from the edge of the workpiece stack is attained even up to the ends of an elongated workpiece of considerable length.

For feeding the workpiece ends into the fabric clamp of the drag-clamp device, there can be provided in the region of the starting position of the drag clamp a positioning device which can be formed with a slide which is adjustable for the desired seam/edge spacing and can be shiftable transversely to the longitudinal edge of the stitching plate and which is formed with a retaining foot. The latter can hold the fabric for mounting in the clamp of the drag-clamp device.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
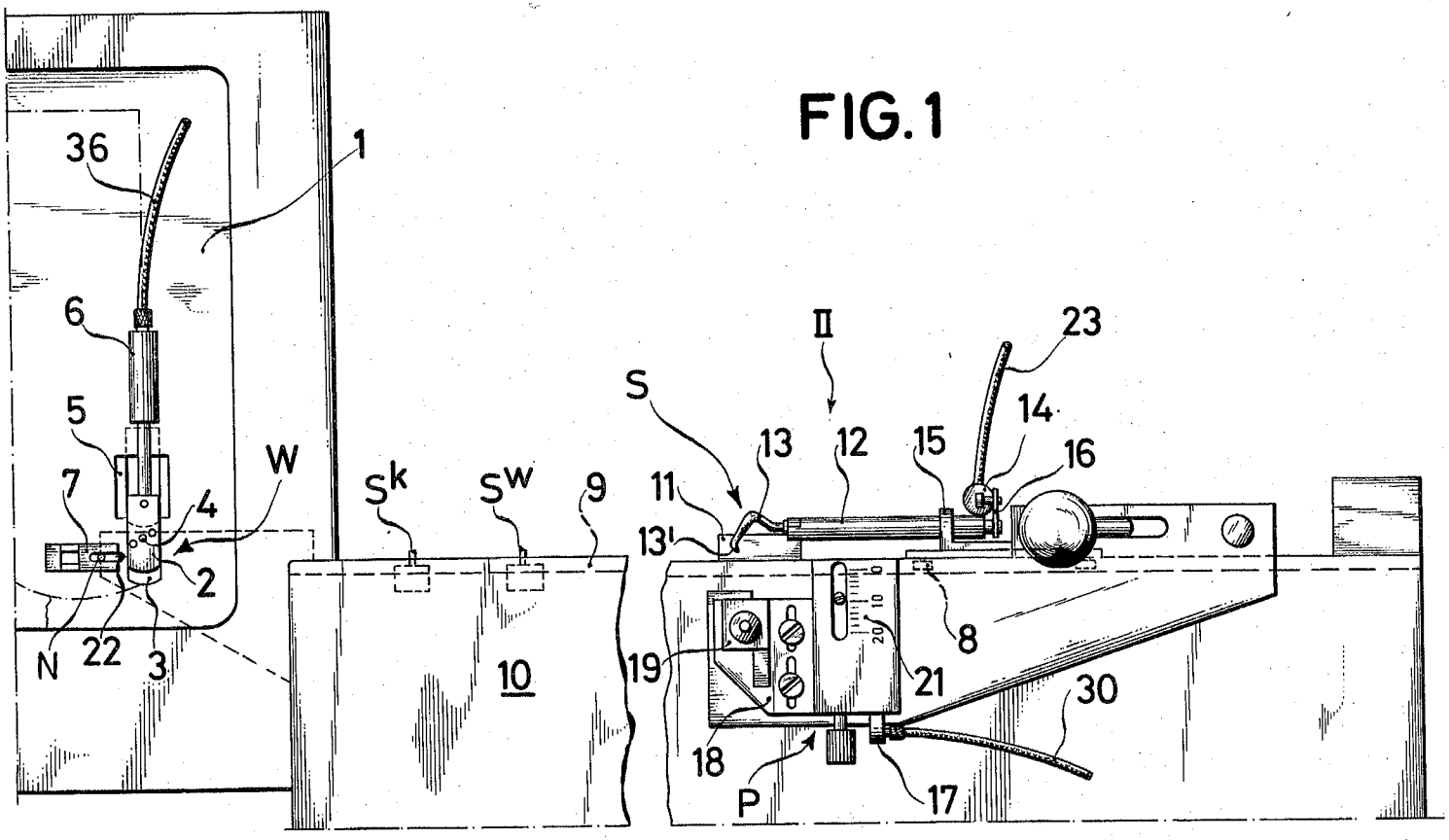
FIG. 1 is a partial plan view of a system according to the present invention with the sewing machine arm and the needle displacement device removed.

On a base plate (stitching plate or work table) 1 of a conventional chain-stitch, double-lockstitch, or lock-stitch sewing machine, whose arm in FIG. 1 has been shown only by a dot-dash outline, there is provided a workpiece-guide device W which is shiftable transversely to the sewing direction.

Figure 2:
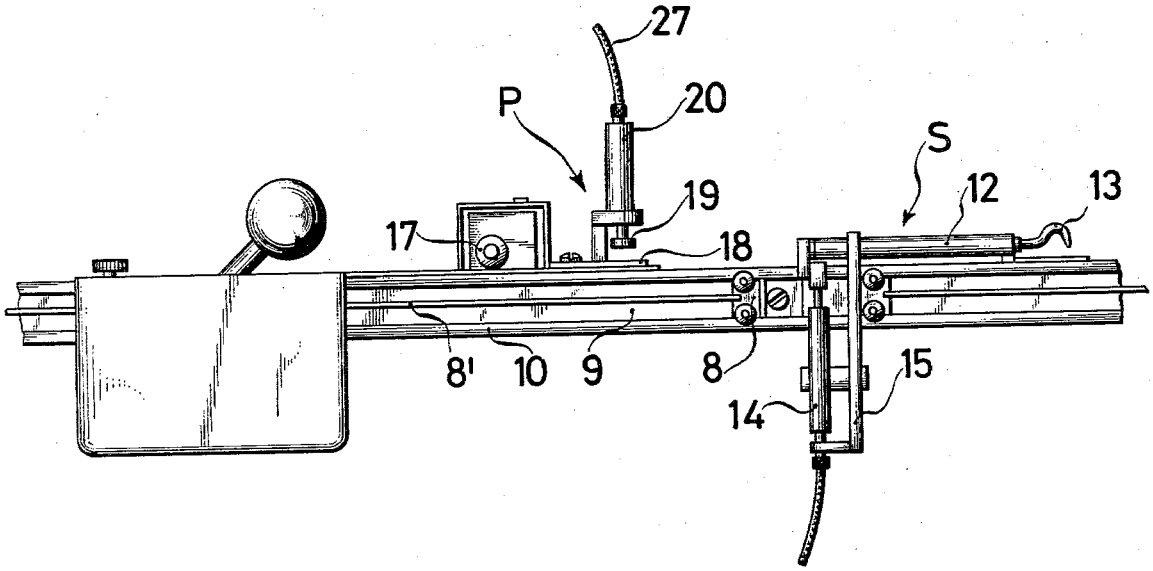
FIG. 2 is a partial elevational view taken in the direction of arrow II of FIG. 1 illustrating the device thereof.
Figure 3:
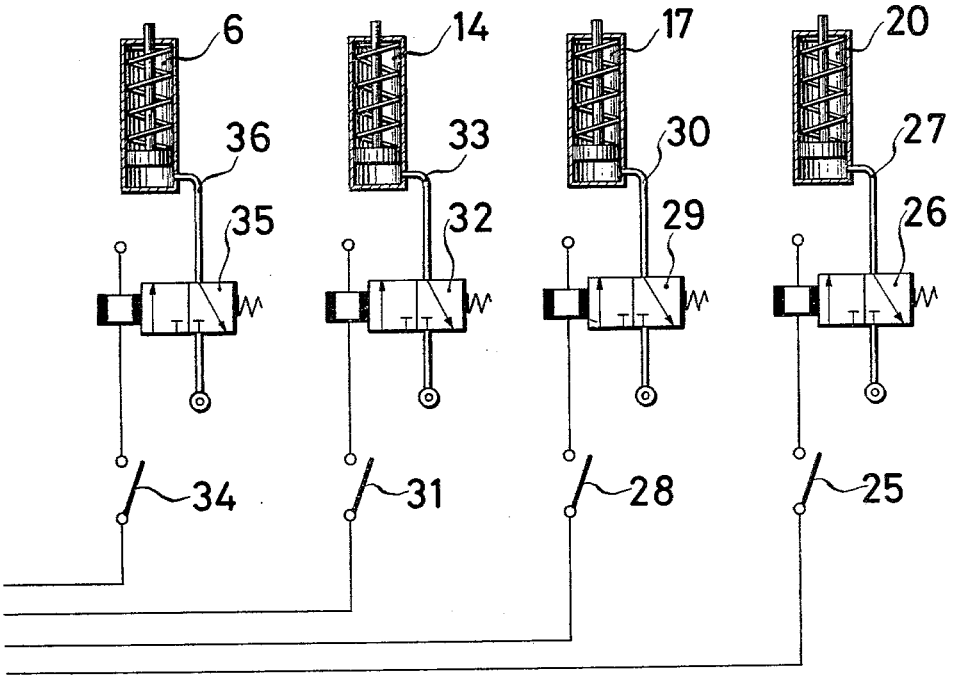
FIG. 3 is a simplified circuit diagram of the pneumatic control system for the device of FIGS. 1 and 2.
Figure 4:
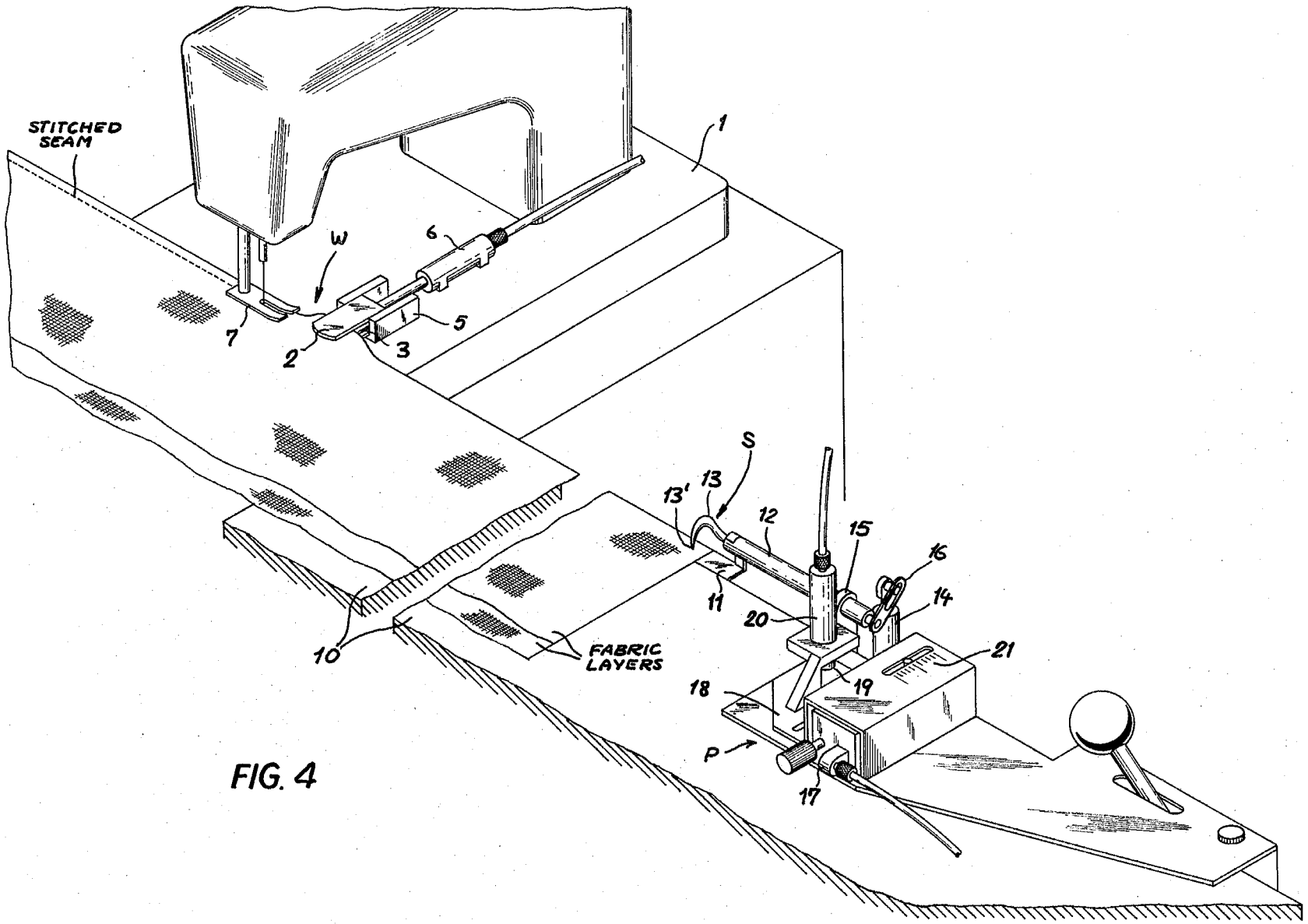
FIG. 4 is a front top perspective view of the system showing the head of the sewing machine in place.

The workpiece-guide device W comprises a plurality of plates 2,3 which are spaced apart and extend in directions parallel to the stitch plate. These plates 2 and 3 are intended to pass between the layers of a multilayer stack forming the elongated workpiece upon which the system of FIGS. 1–3 operates.

The workpiece-guide device W is also formed with a row of pins 4 defining a guide wall which will be referred to herein-after. The "guide wall" may be a line tangent to the pins 4.

Such a workpiece-guide device, i.e. one having a plurality of plates and pins defining a guide wall, is generally known as will be apparent from German utility model (Gebrauchamuster) DT-GB No. 73 30 505. The purpose of such a guide device is to ensure a seam which enables the individual layers to properly position themselves with respect to one another at the stitching location and along the guide wall to produce an edge-parallel stitched seam without monitoring or control by operating personnel.

The workpiece-guide device W is shiftable in a guide 5 mounted on the stitch plate 1 by a pneumatic cylinder 6 perpendicularly to the sewing direction.

In the position shown in FIG. 1, the workpiece-guide device W is in its working position, immediately ahead of the presser foot 7 of the sewing machine. In the second, broken-line position, into which it is displaced as the drag clamp S approaches and toward the end of the seam-forming process, it is out of the path of the drag clamp S.

The drag clamp S comprises a carriage 8 which is guided in a rail 9 on a further work table 10 disposed adjacent the sewing machine.

The carriage 8 is urged to the right (FIG. 1) by a traction cable or wire 8' of a return device urging it in this direction, preferably of the type described in application Ser. No. 769,202 referred to above. The device represented by the wire 8' thus tends to return the clamp and the carriage 8 to its extreme right-hand position, shown in solid lines in FIG. 1, after the clamp of this device has released the workpiece immediately ahead of the stitching location.

The drag clamp S comprises a lower plate-shaped clamping jaw 11 and an upper hook-shaped clamping member 13 which is mounted on a carrying tube 12.

The clamping member 13 is provided with a clamping tip or point 13' for engagement with the fabric. The hook-shaped clamping member 13 is displaceable by means of a pneumatic cylinder 14 which together with the tube 12 is mounted on the carriage 8 by a bracket 15. A link 16 couples the cylinder 14 to the member 13 to enable its rotation in the tube 12 into its clamping position.

In the region of the usual starting position of the drag clamp S, the table 10 is provided with a positioning device which is adjustable as to its starting position. The positioning device comprises a slide 18 which is shiftable transversely to the longitudinal edge of this table by a pneumatic cylinder 17.

The slide 18 is formed with a retaining foot 19 displaceable perpendicularly to the table plane. The retaining foot 19, which is actuatable by a further pneumatic cylinder 20, can engage the fabric workpiece upon the table 10.

The distance between the slide 18 and the longitudinal edge of the table 10 is adjustable via a scale 21 to correspond to the desired edge-seam distance, i.e. the distance between the actual edge of the workpiece which is guided along the wall 4 and the seam inwardly thereof.

The scale 21 thus also reads the position of the point 13' of the pivotal clamping member 13 which can pivot about the axis of tube 12 so that it is precisely in line with the stitch seam to be formed.

The table 10 is swingable (e.g. manually) about a vertical axis which has been represented at 22 by a small cross and defined by an appropriate pivot. This enables workpieces with concave or convex edge patterns to be guided in an edge-parallel manner past the stitching location. The pivot axis 22 lies substantially at the level of the leading edge of the presser foot 7 and substantially at the center of the stitching seam so that, even with a table 10 inclined at an angle with respect to the stitching plate 1, the direction of movement of the clamping tip 13' toward the stitching location will be exactly in line.

Along the path of the clamping device S there are provided two switches $S^w$ and $S^k$ which control the pneumatic cylinders 6 and 14 to the required sequence of operations of the device. This will be apparent from the circuit of FIG. 3.

The fabric layers are so placed on the table 10 that the ends last to be stitched are received in the positioning device P which is located in accordance with the length of the workpieces to be seamed. The coincident edges of the layers are oriented along the longitudinal edge of the table 10 which serves as a guide for alignment of the workpieces.

By means of a manually actuatable contact 25, a magnetic valve 26 is operated to pressurize the line 27 (see FIG. 3) and drive the piston of the associated pneumatic cylinder 20 downwardly so that the retaining foot 19 will engage the workpiece ends and secure them to the slide 18.

The leading ends of the workpieces are inserted into the workpiece guide W and are brought beneath the presser foot 7.

When the machine is set into operation, either by hand or by control means responsive to and sensing the presence of the workpiece, the slide 18 of the positioning device, with the fabric ends clamped beneath the foot 19, entrains the workpiece ends into the drag clamp S. The contact 28 is closed and the magnetic valve 29 in its circuit pressurizes the pneumatic line 30 for the cylinder 17. The clamp 11, 13 of the drag-clamp device S is actuated upon closure of the contact 31 and corresponding energization of the magnetic valve 32 which pressurizes line 33 for the pneumatic cylinder 14. Simultaneously, the contact 25 is opened and the magnetic valve 26 blocks the compressed-air line 27 to raise the foot 19 via a restoring spring of the single-action pneumatic cylinder 20.

During the sewing operation, the drag-clamp device S exerts a light tension, maintaining the workpiece taut while the workpiece is advanced by the feed dogs or the presser foot 7 past the stitching location N. A guidance of the workpiece by hand by a sewing machine sewer is completely unnecessary.

When the drag-clamp device S, in its movement along its track, engages the switch $S^w$, a contact 34 (FIG. 3) closes and energizes a magnetic valve 35 which pressurizes line 36 for the pneumatic cylinder 6.

The pneumatic cylinder 6 draws the workpiece guide W from its solid-line position shown in FIG. 1 into its broken line position illustrated in this figure as well. In this position, the workpiece guide W clears the path for the drag clamp S.

Only immediately prior to passage of the end of the seam to the stitching location N, the clamping device S actuates the further limit switch $S^k$ to interrupt the contacts 31, depressurize the pneumatic cylinder 14, and allow the clamp 11, 13 to open by the restoring force of the spring in the single-action cylinder 14. The cable 8' and the counterweight arrangement attached thereto, or some other restoring device, returns the drag-clamp unit S into its starting position at the level of the positioning device P previously described.

We claim:

1. In combination with a sewing machine adapted to stitch an edge-parallel seam in a workpiece comprising a stack of a plurality of fabric layers and having a stitching location and means for advancing the workpiece past said stitching location, the improvement which comprises:

a workpiece guide device disposed immediately ahead of said stitching location with respect to the direction of advance of the workpiece therepast, said workpiece guide device comprising:

a plurality of plates interleavable with the layers of the workpiece, and an edge guide engageable with the edges of said layers for positioning same to be fed past said location;

a drag-clamp device comprising:

a guide track extending toward said location and formed by a guide rail mounted on a worktable extending laterally from said sewing machine, a drag-clamp displaceable on said guide track and engageable with said workpiece at a location therealong distal from the stitching location upon inception of the seam, and means cooperating with said drag clamp for applying traction to the workpiece along the edge to be seamed;

a retracting means connected to said workpiece guide means and actuatable for drawing same out of the path of said drag clamp;

control means along said track operably by the passage of the drag clamp therealong for actuating said retracting means to withdraw said guide workpiece device out of the path of said drag clamp and enable said drag clamp to approach said stitching location.

2. The improvement defined in claim 1 wherein said sewing machine is formed with a base plate defining said stitching location, said base plate being provided with a guide path substantially transverse to said direction, said retracting means including a pneumatic cylinder connected to said workpiece guide device for displacing same along said guide path, said control means including a switch disposed along said track, and a magnetic valve in circuit with said switch and connected in a pneumatic energizing path to said cylinder.

3. The improvement defined in claim 1 wherein said drag clamp is shiftable along said rail, said rail being swingable about a substantially vertical axis perpendicular to said track and disposed in the region of said stitching location.

4. The improvement defined in claim 1 wherein a worktable extends laterally from said sewing machine and is provided with said track, said worktable being further provided with a positioning device remote from said stitching location and at a location at which a distal end of the workpiece from said stitching location is to be inserted in said drag clamp, said positioning device comprising a slide shiftable transversely to said track and provided with a retaining foot.

5. The improvement defined in claim 1 wherein said drag clamp comprises a lower clamping member in the form of a plate and an upper clamping member having a point engageable with said workpiece and disposed along the line of stitches adapted to form said seam.

6. The improvement defined in claim 3 wherein said sewing machine has a presser foot adjacent said stitching location and said vertical axis is immediately ahead of said presser foot with respect to the direction of advance of said workpiece.

7. The improvement defined in claim 5, further comprising a base plate on said sewing machine defining said stitching location and formed with a guide extending transversely of said direction, said guide means being shiftable in said guide by pneumatic cylinder, said control means including a member disposed along said track for pressurizing said pneumatic cylinder.

8. The improvement defined in claim 7 wherein a worktable extends laterally of said sewing machine and is formed with a guide rail defining said track, and means is provided for swingably mounting said guide rail about a vertical axis perpendicular to said plate and said track.

9. The improvement defined in claim 8, further comprising a positioning slide mounted on said worktable remote from said stitching location and provided with a pneumatic actuator retaining foot for temporarily clamping said layers in the region of the workpiece to be engaged in said drag clamp.

10. The improvement defined in claim 9 wherein said upper clamp member of said drag clamp is pivotal in a tube about the axis thereof, further comprising another pneumatic cylinder operative connected to the pivotal member of said drag clamp.

* * * * *